US011859373B2

(12) United States Patent
Chen

(10) Patent No.: US 11,859,373 B2
(45) Date of Patent: Jan. 2, 2024

(54) FASTENING ASSEMBLY FOR A WATER FAUCET

(71) Applicant: Zhuangyong Chen, Cumming, CA (US)

(72) Inventor: Zhuangyong Chen, Cumming, CA (US)

( * ) Notice: Subject to any disclaimer, the term of this patent is extended or adjusted under 35 U.S.C. 154(b) by 0 days.

(21) Appl. No.: 17/721,850

(22) Filed: Apr. 15, 2022

(65) Prior Publication Data

US 2023/0029539 A1 Feb. 2, 2023

Related U.S. Application Data

(60) Provisional application No. 63/149,527, filed on Feb. 15, 2021.

(51) Int. Cl.
*E03C 1/04* (2006.01)

(52) U.S. Cl.
CPC .... *E03C 1/0402* (2013.01); *E03C 2001/0416* (2013.01)

(58) Field of Classification Search
CPC ..... E03C 1/0401; E03C 1/0402; E03C 2001/0416
See application file for complete search history.

(56) References Cited

U.S. PATENT DOCUMENTS 4,281,857 A * 8/1981 Randall ..... F16L 5/02 411/433
6,328,059 B1 * 12/2001 Testori ..... E03C 1/0401 137/315.12
2002/0120984 A1 * 9/2002 Gray ..... E03C 1/0402 4/684
2016/0258142 A1 * 9/2016 Zou ..... E03C 1/0402

FOREIGN PATENT DOCUMENTS

JP H0893012 A * 9/1994

OTHER PUBLICATIONS

JP0893012A machine translation. Espacenet. (Year: 2023).*

* cited by examiner

*Primary Examiner* — Erin Deery
(74) *Attorney, Agent, or Firm* — Noblitt & Newson, PLLC

(57) ABSTRACT

A fastening assembly for a top-mounted faucet that allows quick and easy installation of the faucet. The fastening assembly includes a plate and a threaded nut. The plate includes an upper grip member made of soft gripping material and a lower support member made of a rigid material. The plate has an elongated central aperture passing through the upper grip member and lower support member. The lower support member includes two flanges that clamp to opposite two faces of the threaded nut.

13 Claims, 12 Drawing Sheets

FASTENING ASSEMBLY FOR A WATER FAUCET

CROSS-REFERENCE TO RELATED APPLICATIONS

This application claims priority from the U.S. provisional patent application Ser. No. 63/149,527, filed on Feb. 15, 2021, which is incorporated herein by reference in its entirety.

FIELD OF INVENTION

The present invention relates to a fastening assembly for a top-mounted faucet, and more particularly, the present invention relates to a fastening assembly for quickly and easily installed top-mounted water faucets, such as a sink faucet.

BACKGROUND

Countertop mounted faucets, also known as top-mount faucets or deck-mount faucets are well known and widely used in homes, in particular in kitchens. Such faucets are mounted on a tabletop or a countertop of a cabinet. The terms "tabletop", "countertop", and "sink basin" are interchangeably used hereinafter. A hole is made or available in the countertop, and the faucet has an elongated threaded tailpiece. The faucet tailpiece is inserted into the hole and a threaded nut can be fastened to the protruding tailpiece from underneath the countertop to secure the faucet. The threaded fastening mechanism is simple, however, fastening the nut from the underside of the countertop can be difficult for many. This is because of the limited space available inside a cabinet or behind the sink basin. The experience of installing a new faucet or replacing an old faucet can become tedious, laborious, and often painful.

Thus, considering the widespread use of countertop-mounted faucets, a need is appreciated for a fastening assembly that makes the process of installation easy and without the need for an individual to reach cramped spaces underneath the countertop.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a fastening assembly for countertop mounted faucets that are easy to install.

It is another object of the present invention that the faucet can be installed quickly.

It is still another object of the present invention that a person installing the faucet does not have to bend or reach cramped spaces underneath the countertop.

It is yet another object of the present invention that the removal of the faucet is also easier.

It is a further object of the present invention that the fastening assembly can be installed without needing any tools, such as a wrench.

In one aspect, disclosed is a fastening assembly for a top-mounted faucet, the fastening assembly comprises a plate comprising: an upper grip member of an elongated geometry, the upper grip member has an elongated first aperture, the upper grip member is made of soft gripping material; and a lower support member configured to fit at an underside of the upper grip member, the lower support member has an elongated second aperture that corresponds to the elongated first aperture, wherein the elongated first aperture and the elongated second aperture define a central elongated aperture in the plate, the lower support member has two flanges that extend downwards from a left side and a right side of the lower support member, the lower support member is made of rigid material; and a threaded nut configured to fit between the two flanges, the threaded nut has two opposite faces such that the two opposite faces juxtapose to the two flanges when the threaded nut is received between the two flanges and the two flanges configured to prevent rotation of the threaded nut.

In one aspect, disclosed is a top-mounted faucet comprising a threaded tailpiece; and a fastening assembly configured to mount to the tailpiece, wherein the fastening assembly comprises: a plate comprising: an upper grip member of an elongated geometry, the upper grip member has an elongated first aperture, the upper grip member is made of soft gripping material, and a lower support member configured to fit at an underside of the upper grip member, the lower support member has an elongated second aperture that corresponds to the elongated first aperture, wherein the elongated first aperture and the elongated second aperture define a central elongated aperture in the plate, the lower support member has two flanges that extend downwards from a left side and a right side of the lower support member, the lower support member is made of rigid material, and a threaded nut configured to fit between the two flanges, the threaded nut has two opposite faces such that the two opposite faces juxtapose to the two flanges when the threaded nut is received between the two flanges and the two flanges configured to prevent rotation of the threaded nut relative to the plate.

In one implementation, the upper grip member further comprises a plurality of protrusions on a top surface of the upper grip member, the plurality of protrusions made of the soft gripping material.

In one implementation, the soft gripping material is rubber, and the rigid material is metal.

In one implementation, the upper grip member further comprises a plurality of male mating members and the lower support member comprises a plurality of female mating members, wherein the plurality of male mating members and the plurality of female mating members are configured to interlock for securing the lower support member to the upper grip member.

In one implementation, a width of the central elongated aperture is more than an outer diameter of the threaded tailpiece of a top-mounted faucet, wherein a length of the central elongated aperture is such that the plate is capable of switching between a tilted position and a horizontal position.

In one aspect, disclosed is a method for mounting a top-mounted faucet to a countertop, the top-mounted faucet has a threaded tailpiece, the countertop has a sinkhole, the method comprises the steps of: providing a fastening assembly configured to mount to the threaded tailpiece, wherein the fastening assembly comprises: a plate comprising: an upper grip member of an elongated geometry, the upper grip member has an elongated first aperture, the upper grip member is made of soft gripping material, and a lower support member configured to fit at an underside of the upper grip member, the lower support member has an elongated second aperture that corresponds to the elongated first aperture, wherein the elongated first aperture and the elongated second aperture define a central elongated aperture in the plate, the lower support member has two flanges that extend downwards from a left side and a right side of the lower support member, the lower support member is made of rigid material, and a threaded nut configured to fit between the two flanges, the threaded nut has two opposite faces such that the two opposite faces juxtapose to the two flanges when the threaded nut is received between the two flanges and the two flanges configured to prevent rotation of the threaded nut relative to the plate.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe embodiments only and is not intended to be limiting to embodiments of the invention. As used herein, the singular forms "a", "an", and "the" are intended to include the plural forms as well, unless the context indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
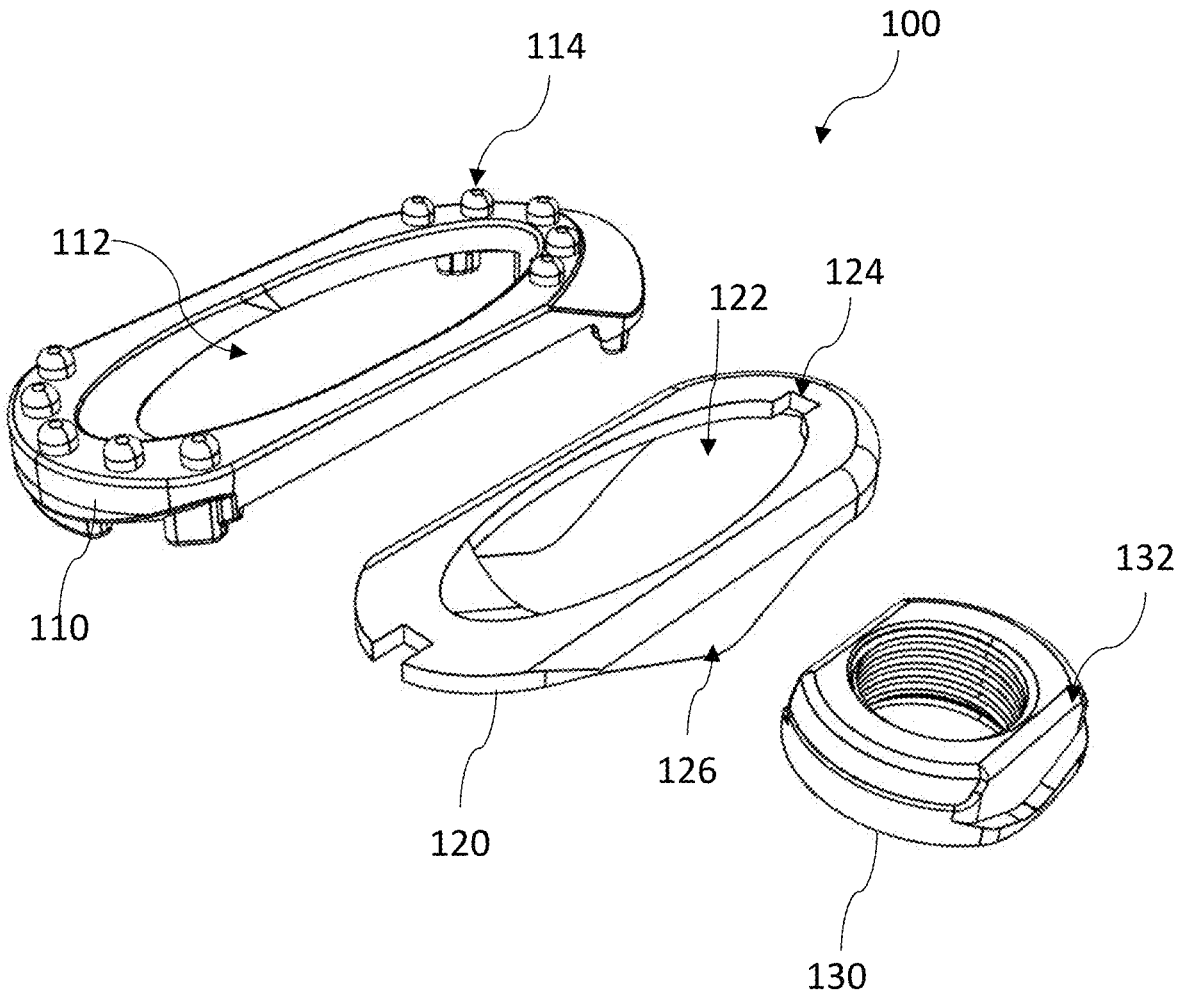
FIG. 1 is an exploded view of the fastening assembly, according to an exemplary embodiment of the present invention.
Figure 2:
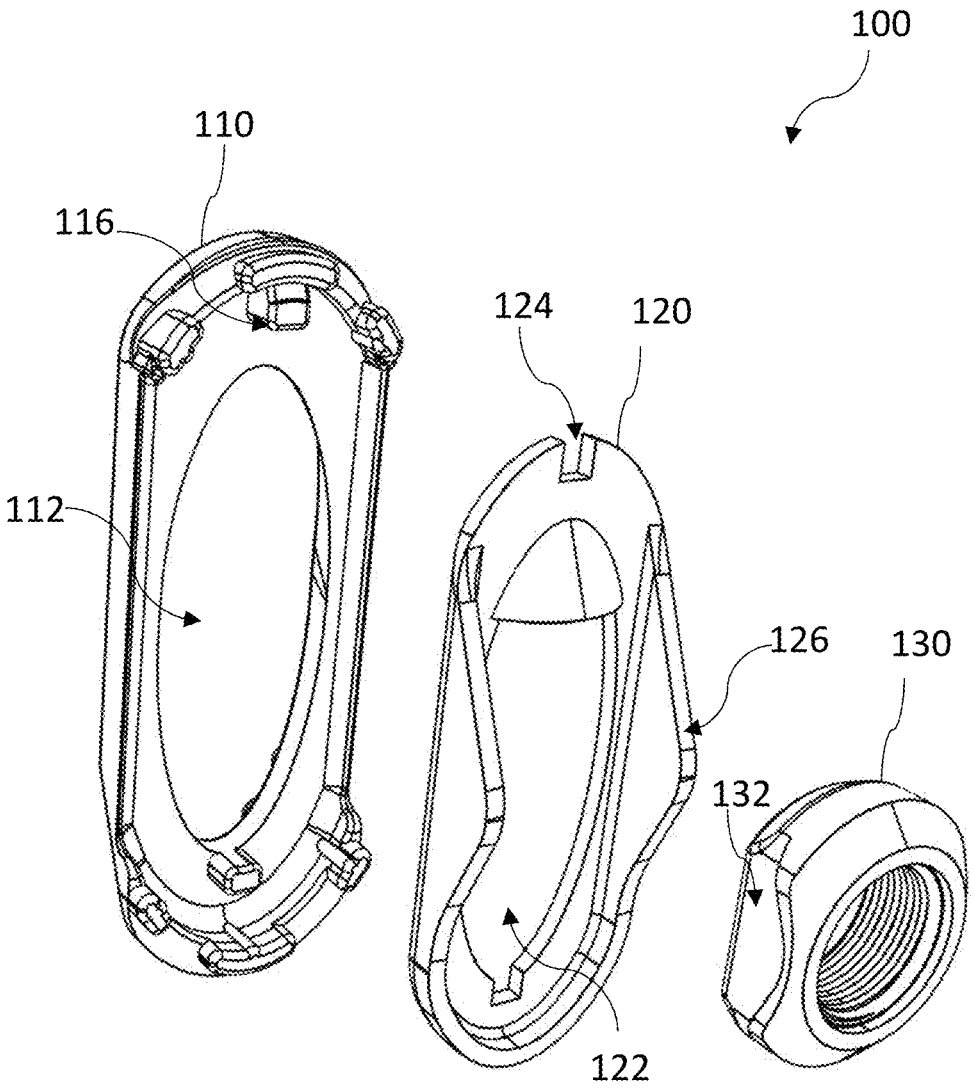
FIG. 2 is another exploded view of the fastening assembly, according to an exemplary embodiment of the present invention.
Figure 3:
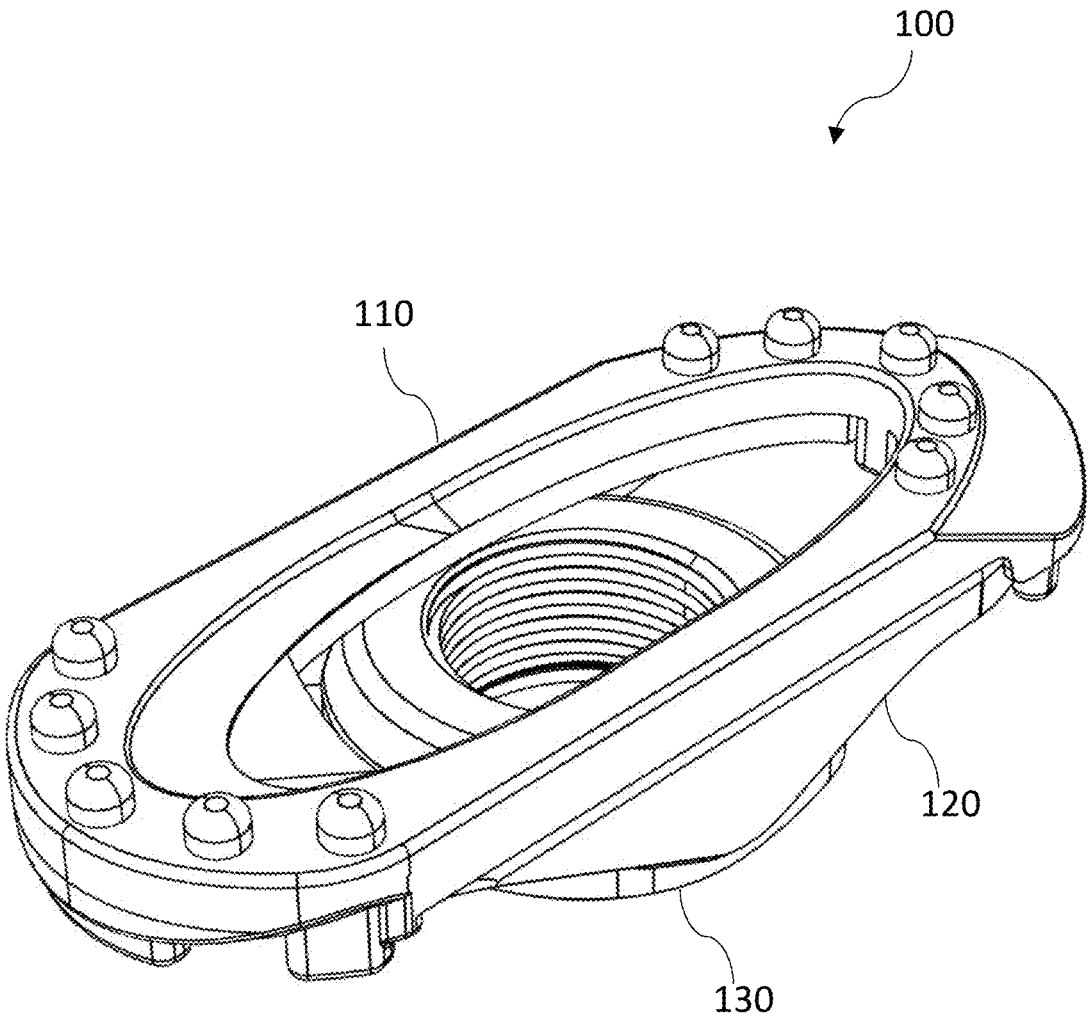
FIG. 3 is a top and side perspective view of the fastening assembly, according to an exemplary embodiment of the present invention.
Figure 4:
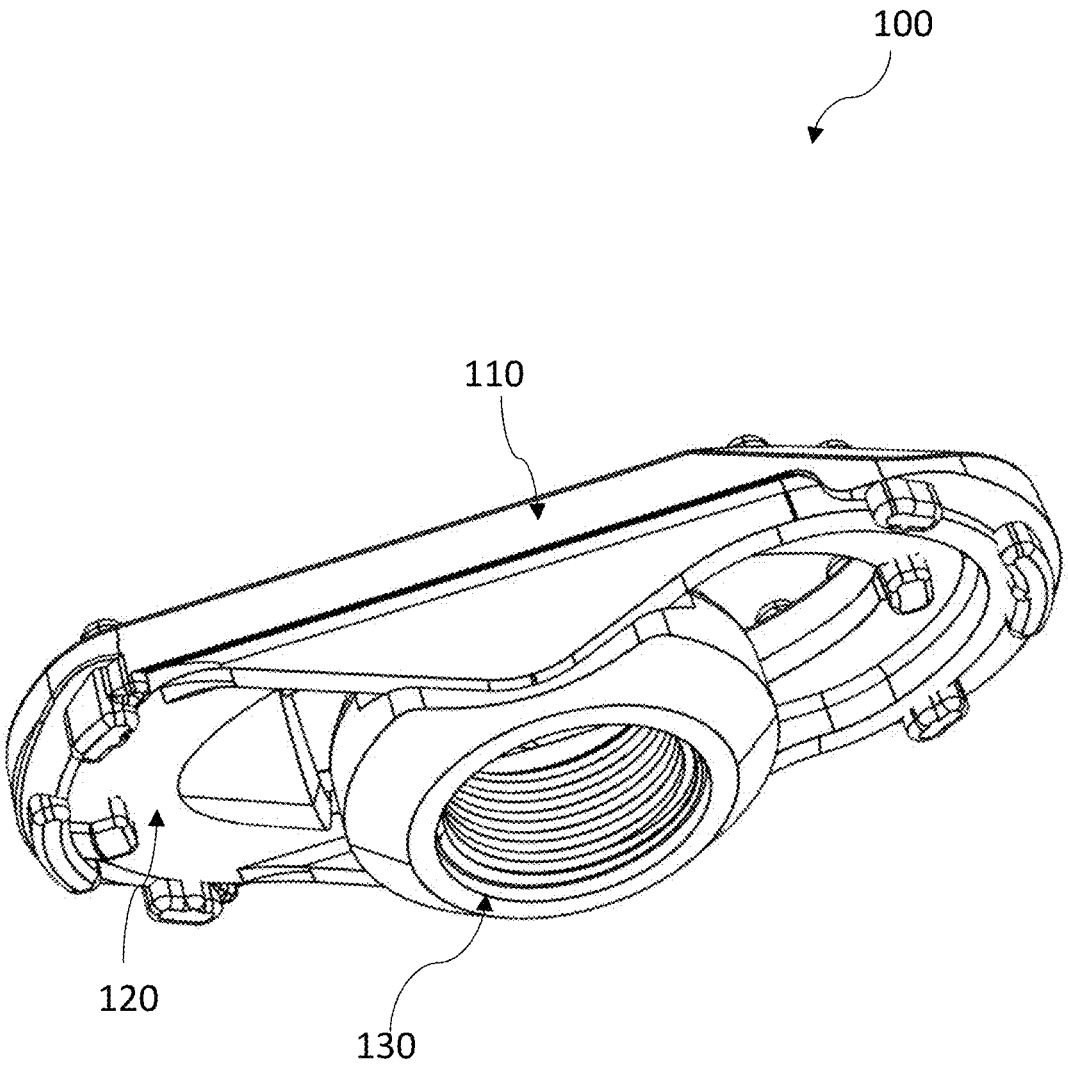
FIG. 4 is a bottom and side perspective view of the fastening assembly, according to an exemplary embodiment of the present invention.
Figure 5:
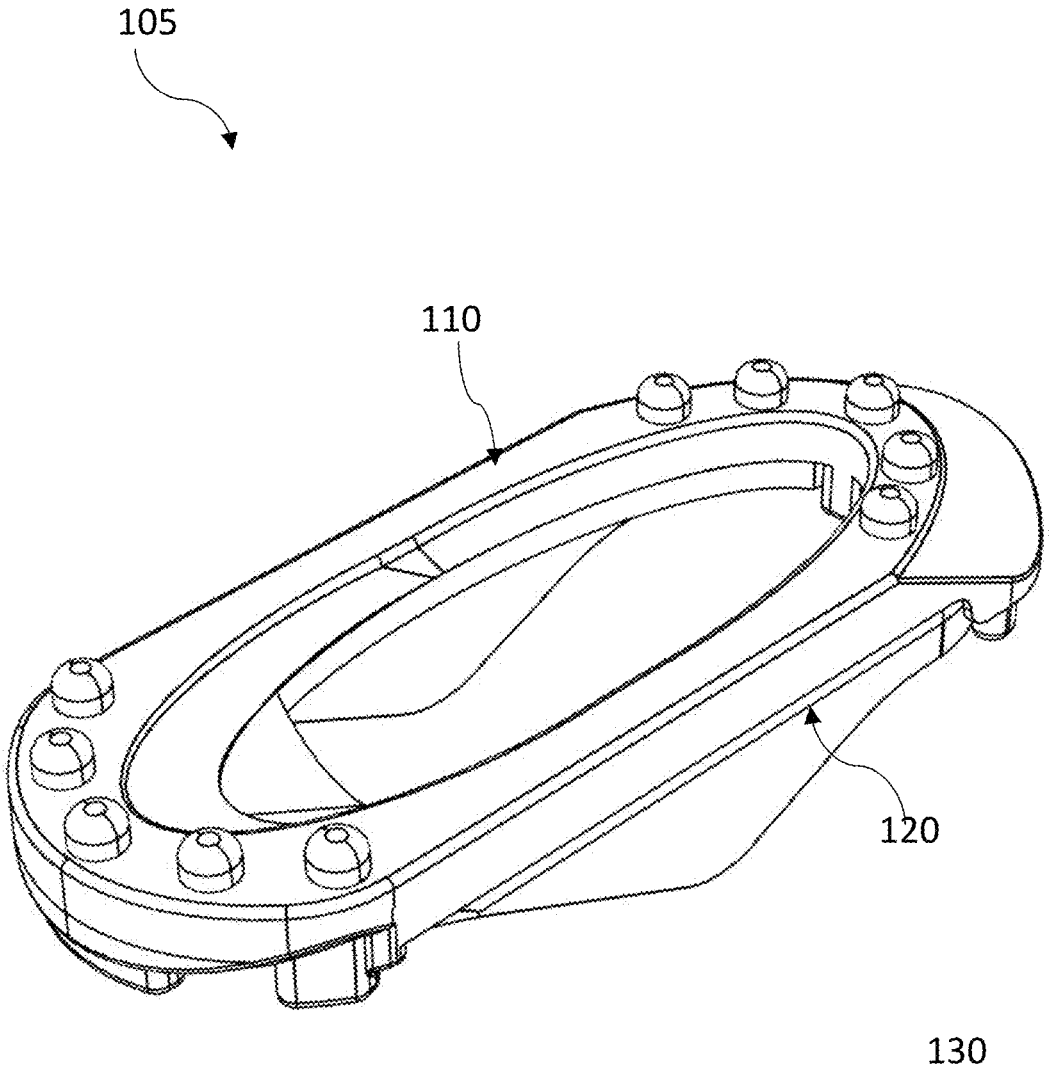
FIG. 5 is a top and side perspective view of a plate of the fastening assembly, according to an exemplary embodiment of the present invention.
Figure 6:
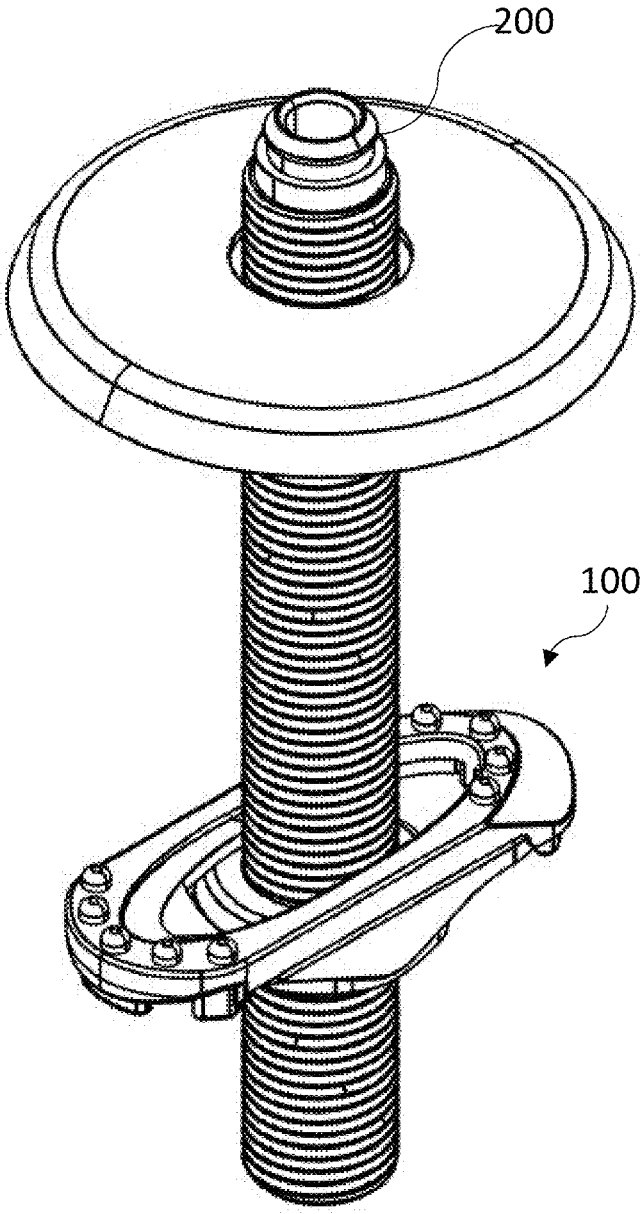
FIG. 6 shows the fastening assembly mounted to a tailpiece of a faucet, according to an exemplary embodiment of the present invention.
Figure 7:
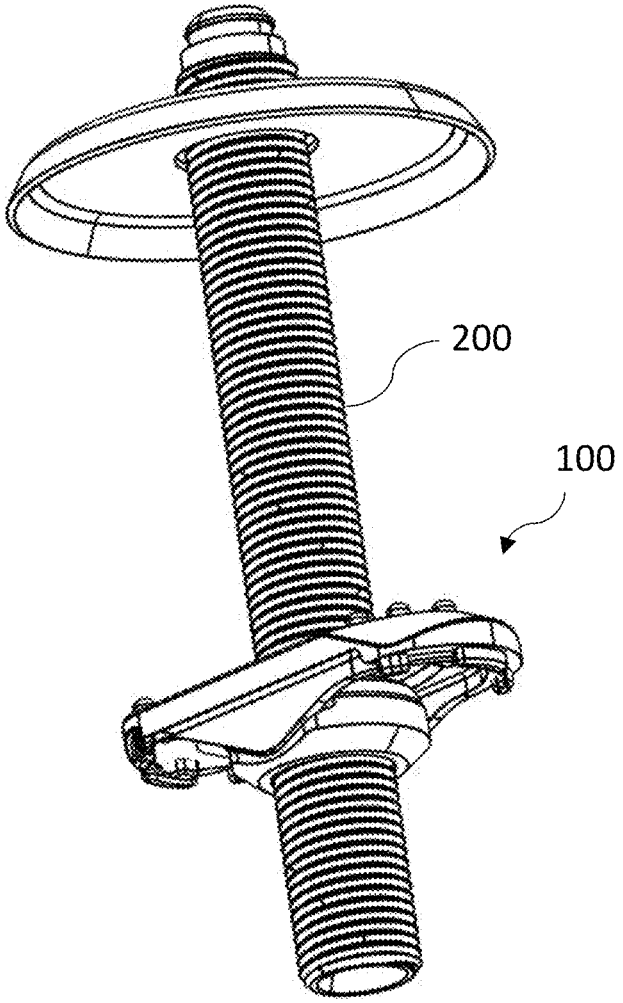
FIG. 7 is another view of the fastening assembly shown in FIG. 6, according to an exemplary embodiment of the present invention.

Disclosed is a fastening assembly for installing a top-mounted faucet, such as the faucets mounted to a countertop. An example of such installation includes a top-mounted Reverse Osmosis Drinking Water Faucet that is installed on sink basins. Referring to FIGS. 1-5 which show an exemplary embodiment of the fastening assembly 100 that can include a plate 105, the plate can be made of an upper grip member 110 and a lower support member 120, wherein the lower support member can fit into an underside of the upper grip member, as shown in FIG. 5. The upper grip member can be made from a soft material, such as rubber that can provide significant slip resistance against a rigid surface, such as an underside of a countertop. The upper grip member 110 can be of an elongated rectangular geometry having a proximal end and a distal end. Both the proximal end and the distal end of the upper grip member 110 are shown rounded. The upper grip member 110 has an elongated oval shape aperture 112 in the center, wherein the oval shape aperture 112 is elongated in the same direction as the upper grip member 110. The dimensions of the upper grip member 110 and the oval shape aperture 112 can depend upon a size of a sinkhole in the countertop and a diameter of a tailpiece/stem of a faucet respectively, as described below in reference to FIGS. 5-10. The upper grip member 110 can further include several protrusions 114 extended upwards from the top of the upper grip member 110. The protrusions 114 can be made of the same material as the rest of the upper grip member 110 or a different material. The protrusions 114 can enhance the grip against a surface over which the upper grip member 110 is pressed against. On the lower side of the upper grip member, 110 are shown several male mating members 116 that can function to secure the lower support member 120 to the upper grip member 110.

The lower support member 120 can fit into the underside of the upper grip member 110 and can provide structural support to the softer upper grip member 110. The lower support member 120 can be rigid and durable in structure, such as made from metal or similar material. The lower support member 120 can also be of a similar geometry as the upper grip member 110, i.e., having an elongated rectangular geometry and an elongated oval aperture 122 that correspond to the oval shape aperture 112 in the upper grip member 110. The lower support member 120 can also have several female mating members 124, the positions of which correspond to the male mating members 116, such that the female mating members 124 can be coupled to the male mating members 116 for securing the upper grip member 110 and the lower support member 120 together. Furthermore, as shown in the drawings, the upper grip member 110 can overlap the lower support member 120. The lower support member 120 can also have two opposite flanges 126 that extend downwards from a left side and right-side periphery of the lower support member 120.

The plate 105 can further include a threaded nut 130 that can be fastened to the tailpiece of the faucet. While nut 130 is shown in the drawings to be rounded, however, the nut can be of any other shape, such as hexagonal, square, and the like. The nut 130 can have at least two opposite flat faces 132, the opposite flat faces are positioned such that when the nut 130 is positioned below the lower support member 120 and between the two flanges 126, the opposite flat faces 132 of the nut 130 can juxtapose to inner sides of the two flanges 126 and the two flanges prevent rotation of the nut 130 respective to the plate 105.

Figure 8:
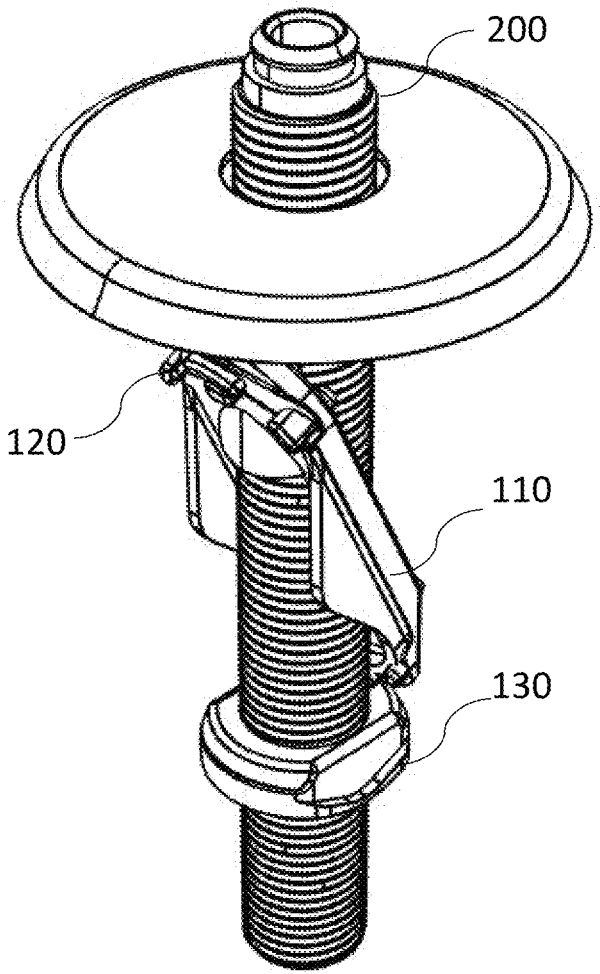
FIG. 8 shows the fastening assembly of FIG. 6, but the plate is shown in a tilted position, according to an exemplary embodiment of the present invention.
Figure 9:
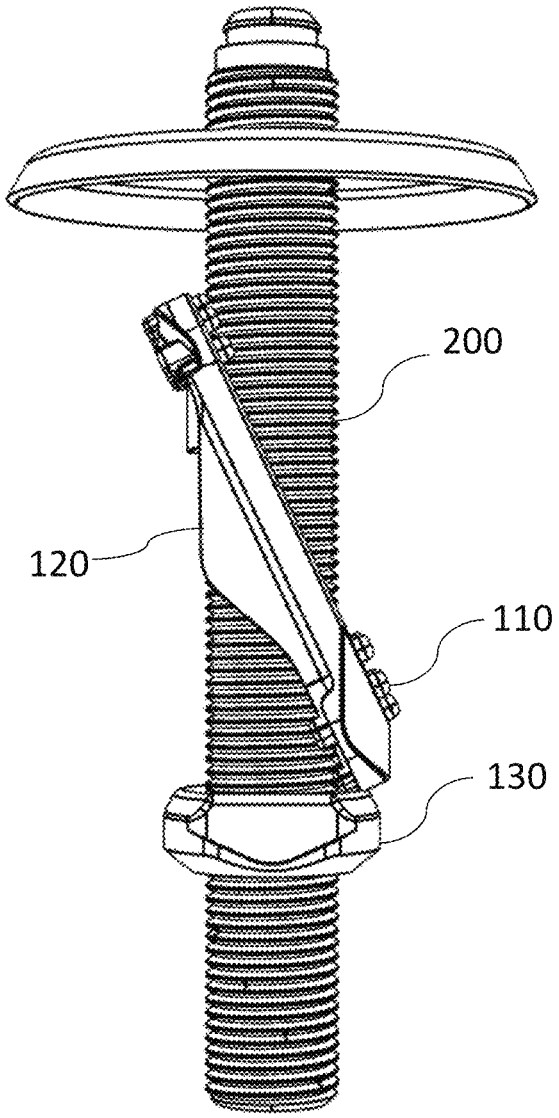
FIG. 9 is a side view of the fastening assembly shown in FIG. 8, according to an exemplary embodiment of the present invention.
Figure 10:
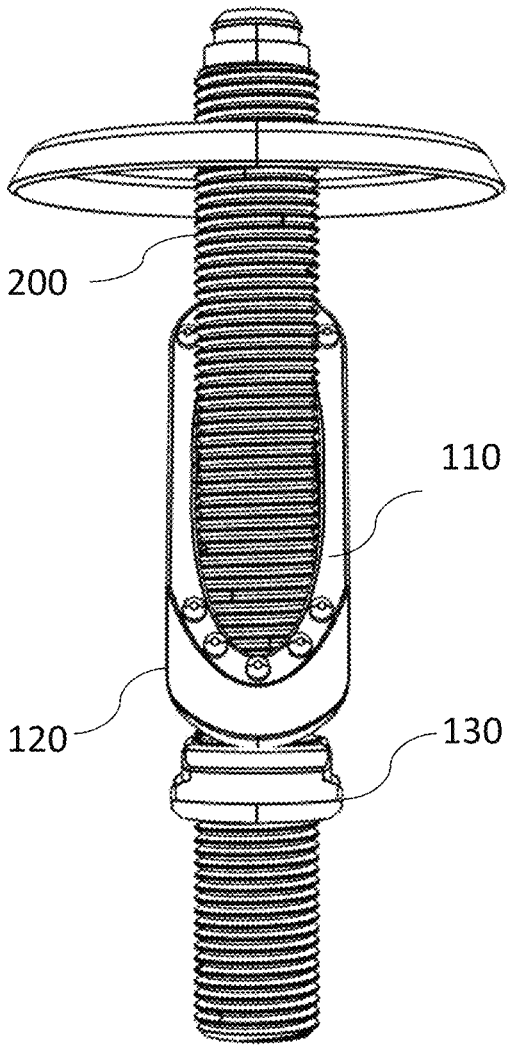
FIG. 10 is a front view of the fastening assembly shown in FIG. 8, according to an exemplary embodiment of the present invention.

Referring to FIGS. 6-10 which show a tailpiece 200 of a faucet, the faucet is not shown. The tailpiece 200, also known as stem, is threaded and extends downwards from a faucet. The plate 105 of the disclosed fastening assembly 100 may pass-through receive the tailpiece 200, wherein the tailpiece 200 extends through the central elongated aperture defined by the apertures in the upper grip member 110 and the lower support member 120. The tailpiece 200 can freely pass through the central elongated aperture in plate 105. Once the tailpiece 200 is received within the central elongated aperture of the plate 105, the nut 130 can be fastened to the tailpiece 200. The elongated oval shape aperture in the plate 105 allows the plate 105 to be tilted, as shown in FIGS. 8-10. In the titled position, the tailpiece 200 along with the fastening assembly 100 can pass through the sinkhole of the countertop. Thus, the dimensions of the plate 105 and dimensions of the central elongated aperture in the plate 105 can be such that in the tilted position of the plate 105, the fastening assembly 100 mounted to a tailpiece of a faucet can pass through a sinkhole in the countertop in which the faucet has to be installed. The diameter of the sinkhole may vary and accordingly, the size of plate 105 may also vary. However, the sinkholes are made in standard dimensions, and so the disclosed fastening assembly can be manufactured for standard size sinkholes.

Figure 11:
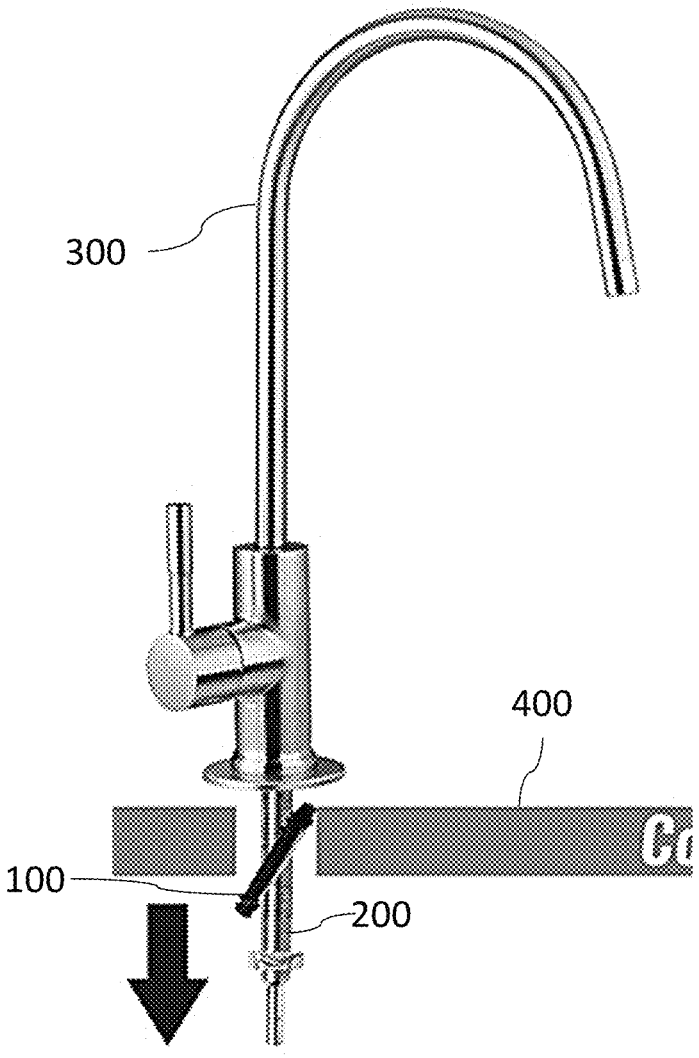
FIG. 11 shows a step of installation of a faucet on a countertop, wherein the fastening assembly is in a tilted position such that it passes through a sinkhole in the countertop, according to an exemplary embodiment of the present invention.
Figure 12:
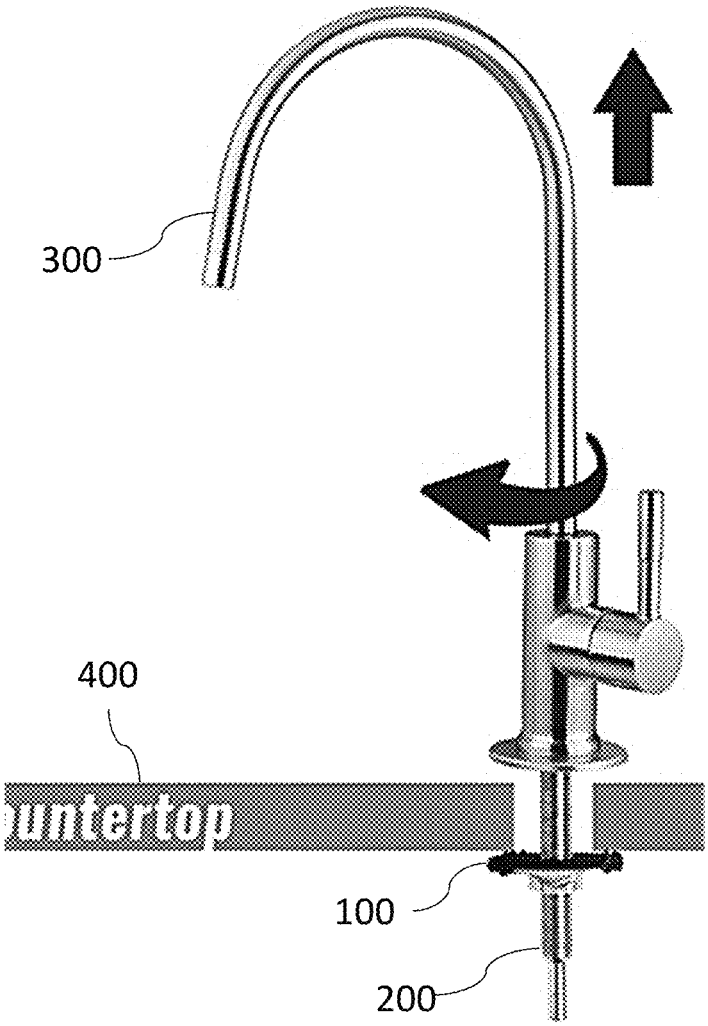
FIG. 12 shows the steps of lifting and turning the faucet, according to an exemplary embodiment of the present invention.

For use, referring to FIGS. 11 and 12, the faucet 300 with the fastening assembly 100 mounted over the tailpiece 200, can be dropped into the sinkhole in the countertop 400. FIG. 11 shows the faucet 300 being dropped into the sinkhole, while the plate 105 is in the tilted position. The plate 105 in the tilted position can pass through the sinkhole, but not in the horizontal position, as shown in FIG. 12. Once, the fastening assembly 100 is below the countertop, as shown in FIG. 12, the faucet can be lifted to press the upper grip member 110 against the bottom of the countertop. While plate 105 is pressed against the countertop, faucet 300 can be turned clockwise. The grip of the upper grip member 110 against the bottom of the countertop 400 can prevent the plate 105 from slipping, moreover, the flanges 126 of the lower support member 120 can prevent the rotation of the nut 130, thus the tailpiece 200 can rotate respective to the nut 130, resulting in screwing of the nut 130 over the tailpiece 200. The faucet 300 can be rotated until the nut 130 tightens, and any further rotation of the faucet is resisted. The protrusions 114 of the upper grip member 110 can allow minor adjustments in the rotation of the faucet, i.e., to align the orientation of the faucet 300 in the desired direction.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A fastening assembly for a top-mounted faucet, the fastening assembly comprises:

a plate comprising:

an upper grip member of an elongated geometry, the upper grip member has an elongated first aperture, the upper grip member is made of soft gripping material, the upper grip member comprises a plurality of protrusions on a top surface of the upper grip member, the plurality of protrusions made of the soft gripping material; and a lower support member configured to fit at an underside of the upper grip member, the lower support member has an elongated second aperture that corresponds to the elongated first aperture, wherein the elongated first aperture and the elongated second aperture define a central elongated aperture in the plate, the lower support member has two flanges that extend downwards from a left side and a right side respectively of the lower support member, the lower support member is made of rigid material; and a threaded nut configured to fit between the two flanges, the threaded nut has two opposite faces such that the two opposite faces configured to juxtapose to the two flanges when the threaded nut is received between the two flanges and the two flanges are configured to prevent rotation of the threaded nut relative to the plate.

2. The fastening assembly according to claim 1, wherein the soft gripping material is rubber, and the rigid material is metal.

3. The fastening assembly according to claim 1, wherein the upper grip member further comprises a plurality of male mating members and the lower support member comprises a plurality of female mating members, wherein the plurality of male mating members and the plurality of female mating members are configured to interlock for securing the lower support member to the upper grip member.

4. The fastening assembly according to claim 1, wherein a width of the central elongated aperture is more than an outer diameter of a threaded tailpiece of the top-mounted faucet, wherein a length of the central elongated aperture is such that the plate is capable of switching between a tilted position and a horizontal position.

5. A top-mounted faucet comprising:

a threaded tailpiece; and a fastening assembly configured to mount to the threaded tailpiece, wherein the fastening assembly comprises:

a plate comprising:

an upper grip member of an elongated geometry, the upper grip member has an elongated first aperture, the upper grip member is made of soft gripping material, and a lower support member configured to fit at an underside of the upper grip member, the lower support member has an elongated second aperture that corresponds to the elongated first aperture, wherein the elongated first aperture and the elongated second aperture define a central elongated aperture in the plate, the lower support member has two flanges that extend downwards from a left side and a right side respectively of the lower support member, the lower support member is made of rigid material, and a threaded nut configured to fit between the two flanges, the threaded nut has two opposite faces such that the two opposite faces configured to juxtapose to the two flanges when the threaded nut is received between the two flanges and the two flanges are configured to prevent rotation of the threaded nut relative to the plate, wherein the upper grip member further comprises a plurality of male mating members and the lower support member comprises a plurality of female mating members, wherein the plurality of male mating members and the plurality of female mating members are configured to interlock for securing the lower support member to the upper grip member.

6. The top-mounted faucet according to claim 5, wherein the upper grip member further comprises a plurality of protrusions on a top surface of the upper grip member, the plurality of protrusions made of the soft gripping material.

7. The top-mounted faucet according to claim 5, wherein the soft gripping material is rubber, and the rigid material is metal.

8. The top-mounted faucet according to claim 5, wherein a width of the central elongated aperture is more than an outer diameter of the threaded tailpiece of the top-mounted faucet, wherein a length of the central elongated aperture is such that the plate is capable of switching between a tilted position and a horizontal position.

9. A method for mounting a top-mounted faucet to a countertop, the top-mounted faucet has a threaded tailpiece, the countertop has a sinkhole, the method comprises the steps of:

providing a fastening assembly configured to mount to the threaded tailpiece, wherein the fastening assembly comprises:

a plate comprising:

an upper grip member of an elongated geometry, the upper grip member has an elongated first aperture, the upper grip member is made of soft gripping material, and a lower support member configured to fit at an underside of the upper grip member, the lower support member has an elongated second aperture that corresponds to the elongated first aperture, wherein the elongated first aperture and the elongated second aperture define a central elongated aperture in the plate, the lower support member has two flanges that extend downwards from a left side and a right side respectively of the lower support member, the lower support member is made of rigid material, wherein the upper grip member further comprises a plurality of protrusions on a top surface of the upper grip member, the plurality of protrusions is made of the soft gripping material, and a threaded nut configured to fit between the two flanges, the threaded nut has two opposite faces such that the two opposite faces are configured to juxtapose to the two flanges when the threaded nut is received between the two flanges and the two flanges are configured to prevent rotation of the threaded nut relative to the plate; and mounting the top-mounted faucet at the sinkhole.

10. The method according to claim 9, wherein the soft gripping material is rubber, and the rigid material is metal.

11. The method according to claim 9, wherein the upper grip member further comprises a plurality of male mating members and the lower support member comprises a plurality of female mating members, wherein the plurality of male mating members and the plurality of female mating members are configured to interlock for securing the lower support member to the upper grip member.

12. The method according to claim 9, wherein a width of the central elongated aperture is more than an outer diameter of the threaded tailpiece of the top-mounted faucet, wherein a length of the central elongated aperture is such that the plate is capable of switching between a tilted position and a horizontal position.

13. A fastening assembly for a top-mounted faucet, the fastening assembly comprises:

a plate comprising:

an upper grip member of an elongated geometry, the upper grip member has an elongated first aperture, the upper grip member is made of soft gripping material, the upper grip comprises a plurality of male mating members; and a lower support member configured to fit at an underside of the upper grip member, the lower support member has an elongated second aperture that corresponds to the elongated first aperture, wherein the elongated first aperture and the elongated second aperture define a central elongated aperture in the plate, the lower support member has two flanges that extend downwards from a left side and a right side respectively of the lower support member, the lower support member is made of rigid material, the lower support member comprises a plurality of female mating members, wherein the plurality of male mating members and the plurality of female mating members are configured to interlock for securing the lower support member to the upper grip member; and a threaded nut configured to fit between the two flanges, the threaded nut has two opposite faces such that the two opposite faces configured to juxtapose to the two flanges when the threaded nut is received between the two flanges and the two flanges are configured to prevent rotation of the threaded nut relative to the plate.

* * * * *